United States Patent [19]

Lutchansky

[11] 4,380,838

[45] Apr. 26, 1983

[54] CONFORMABLE SUPPORT SYSTEM FOR FURNITURE

[76] Inventor: Milton Lutchansky, 47 Lake Shore Dr., Randolph, N.J. 07869

[21] Appl. No.: 252,179

[22] Filed: Apr. 8, 1981

[51] Int. Cl.[3] ..... A61G 7/00

[52] U.S. Cl. ..... 5/66; 5/72; 5/80

[58] Field of Search ..... 5/60, 66–69, 5/72, 80; 297/68, 284, 316, 359, 444, 460

[56] References Cited

U.S. PATENT DOCUMENTS

| | | | |
|---|---|---|---|
| 847,758 | 3/1907 | Frye | 5/69 |
| 1,550,462 | 8/1925 | Sisbower et al. | 5/69 |
| 3,253,285 | 5/1966 | Fox | 5/66 |
| 3,319,270 | 5/1967 | Greiner | 5/66 |
| 3,790,150 | 2/1979 | Lippert | 297/452 |
| 4,033,567 | 7/1977 | Lipfert | 297/458 |

FOREIGN PATENT DOCUMENTS

| | | | |
|---|---|---|---|
| WO80/01979 | 10/1980 | PCT Int'l Appl. | 5/66 |
| 597799 | 11/1977 | Switzerland | 5/66 |

*Primary Examiner*—Francis K. Zugel
*Assistant Examiner*—Michael F. Trettel
*Attorney, Agent, or Firm*—J. P. Kearns

[57] ABSTRACT

An article of furniture, such as a bed or a chair, provides improved comfort by supporting a human body resting thereon and adaptively conforming to the body contours in contact with the support surface while providing a distribution of support forces that does not vary significantly as the contour changes. A segmented frame pivotally supported on pairs of balance levers which in turn are pivotally attached to a firm base provides a floating action. When ratios of distances of lever ends from their pivot points are selected in inverse ratio to the weights of the human body sections to be supported by attached frame segments, the resulting distribution of support forces matches the distribution of weight in the body and tends to relieve muscle tension.

9 Claims, 6 Drawing Figures

CONFORMABLE SUPPORT SYSTEM FOR FURNITURE

FIELD OF THE INVENTION

This invention relates to a support system for furniture, such as beds and chairs. More particularly, it relates to a support system for such furniture which readily conforms to the contour of the body resting on the furniture while supporting the body with a force distribution that is virtually independent of the contour of the supported body.

BACKGROUND OF THE INVENTION

Body support furniture currently in use falls broadly into two categories: elastic type, such as inner spring construction, and fluid type, such as waterbeds. In the elastic support type the pressure distribution provided is largely a function of the differences between the contour of the body surface in direct contact with the furniture surface and the unloaded contour thereof. In the case of a bed, the unloaded contour would normally be flat. Those portions of the body which project the most, in the heavier sections of the body, such as the pelvic or scapular sections, are reacted upon by the higher levels of the elastic support pressure distribution. The reactions of the elastic type support are by definition proportional to deflection. The support force distributions from such systems do not, in general, match the weight distribution of the supported body unless the body bends in ways to make its surface conform to the unloaded contour of the support surface. If the body does not conform in this fashion it must act like a structural beam providing a bridging action from one support point to another. To act as a rigid beam the required muscle tension leads to an internal source of discomfort in addition to the discomfort created by the concentration of support forces at discrete locations along the surface of the body. Another characteristic of elastic support systems is that in order to provide a smoother pressure distribution along the body surface a relatively soft support is required. A soft support usually sags excessively in the lumbar region and often results in internal discomfort.

Fluid support systems, such as waterbeds, on the other hand, overcome to a large degree the irregular nature of the support force distribution of elastic systems and provide support force distributions much less dependent on surface contour. Certain other disadvantages, however, are inherent in waterbeds, such as the relatively large mass and bulk of the devices, the need for heaters, and the wave motion.

Accordingly, it is an object of this invention to provide a support system for furniture, such as beds and chairs, which will readily adapt to the contours of different bodies and their aspects supported thereby.

Another object is to provide a support system which will readily conform to changes in contour of a body being supported by reason of shifts in body position.

A further object is to provide a support system for furniture by which bodies thereon are supported with a distribution of pressure that varies smoothly and is spread over a relatively large area of the body surface and minimizes the spread between the highest and lowest levels of the pressure distribution.

A still further object is to provide a support system for furniture by which bodies thereon are supported by a largely predetermined distribution of support pressures and in which little variation in local resultant support forces occurs even when the body contour changes.

Yet another object is to provide a support system for furniture which provides a support force distribution matched to the weight distribution of the supported body, independently of the body contour in contact with the support system.

Other objects are to provide a support system for furniture which permits the selection of any of a plurality of desired support system force distributions; to provide a support system that can have the comfortable feel of a soft mattress pad in contact with the body while effecting the kind of support needed for a natural body posture in order to prevent internal muscle tension; and to provide a support system whose support forces closely match the weight of each body section.

SUMMARY OF THE INVENTION

The foregoing objects and others are achieved in accordance with the principles of this invention by a support system which comprises a membrane; a movable, segmented frame upon which such membrane is stretched; pivoted lever means bearing the several frame segments; and a fixed base underlying such lever means.

The segmenting scheme for the frame is selected to match, generally, the major segments of the supported body for the purpose of minimizing the required number of support points while at the same time providing satisfactory smoothing means for the support force distribution. There results a support pressure distribution free of concentrated pressure points on the supported body for a wide range of body positions and contours.

This invention is an improvement over the Body Contour Accommodating Support System described in my prior U.S. Pat. No. 3,717,376 granted on Feb. 20, 1973. In my prior patent I disclosed the use of transverse slats as the supporting means for a mattress pad. My present invention makes use of a membrane stretched on a movable, segmented frame. The membrane itself can be continuous in nature, e.g., composed of wire mesh, or it can be discontinuous, e.g., comprising a set of webbing strips. The movable frame on which the membrane is stretched is segmented and the crossbraced frame segments are supported in pairs by levers pivoted on fixed members. The supporting members can thus readily change positions relative to each other to accommodate a change in the contour of the supported body. The supporting segments and interconnecting levers provide a set of relatively constant support forces for a plurality of equilibrium configurations. The spatial distribution of the support force magnitudes is almost entirely a function of design parameters of the support system and is substantially independent of the contour of the supported body.

Unlike the slatted support arrangement described in my prior patent the present invention accommodates a mattress pad with an upper surface that is flexible not only along the longitudinal axis of the supported body, but also transversely of the longitudinal axis. More uniform support is thus provided to the overlying body over a larger percentage of its surface than in structures of the prior art. The upper surface of the present structure comprises a membrane which is under tension in the direction transverse to the longitudinal axis, but which is virtually tension free along that axis. The support system further comprises a segmented frame with segments that provide rigid edge members running in the longitudinal direction and rigid cross braces such that the membrane is provided with relatively rigid attachment points along its longitudinal sides.

The invention further provides, in one of its embodiments, a frame divided into the minimum number of segments deemed necessary to achieve the objectives of providing a smooth pressure distribution to the surface of the body, independently of its contour, and a support distribution well matched to the weight distribution in the supported body. The number of support points in this embodiment is also reduced to the lowest number requisite to achieving the recited objects.

A smaller or larger number of segments and support points can be used within the scope of this invention.

In another embodiment of my invention the support system provides upper torso support only, e.g., in a lounge chair in which the lower portion of the chair is a known arrangement. My support system is applicable to multi-position furniture, such as beach chairs, hospital beds, recliners, and seats in buses, aircraft and automobiles.

BRIEF DESCRIPTION OF THE DRAWING

My invention will be more fully understood from the following detailed description and the accompanying drawing in which.

DETAILED DESCRIPTION

Figure 1:
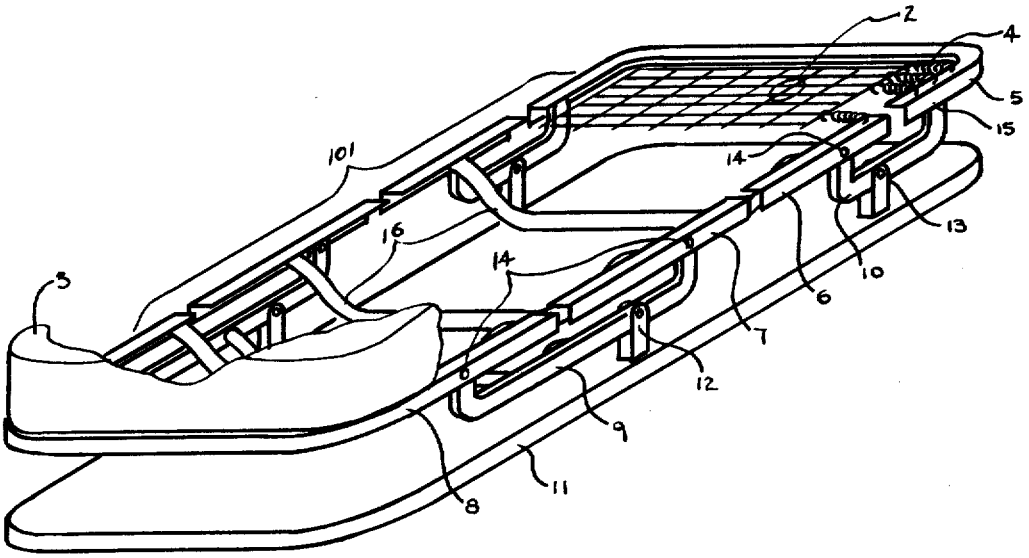
FIG. 1 is a perspective view of a bed incorporating the support system of my invention.
Figure 2:
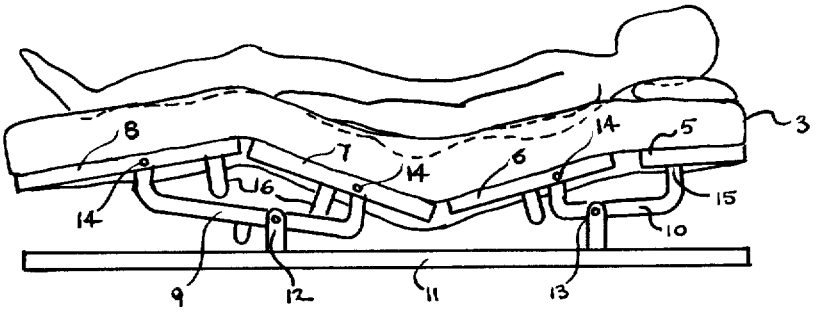
FIG. 2 is a side pictorial view of the support system of my invention showing a user lying in the supine position.
Figure 3:
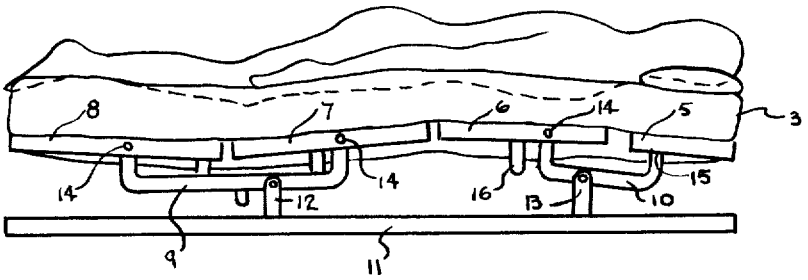
FIG. 3 is a side pictorial view of the support system of my invention showing a user lying in the prone position.

FIGS. 1, 2 and 3 show a first embodiment of my invention incorporated in a bed having a floating, segmented body support structure over which is placed a mattress pad composed, for example, of a resilient material, such as polymeric foam. The support structure comprises a movable segmented frame 101, membrane 2 stretched on segmented frame 101, balance lever members 9 and 10, fixed support members 12 and 13, and platform base 11. In the embodiment of FIG. 1 membrane 2 is attached to movable, segmented frame 101 by means of helical springs 4. The floating, flexing frame 101 is divided into four segments of angle iron, for example, including a head support segment 5, an upper support segment 6, lower torso and thigh supporting segment 7, and lower leg and foot support segment 8. The lengths and positions of segments 5 through 8 are chosen to match approximately the lengths and positions of the corresponding segments of the supported human body. The pivot points 14 are placed at the approximate centers of gravity of the body segments. The support force means shown in FIG. 1 are balance levers 9 and 10 pivotally supported from the fixed platform 11 at appropriately located fixed support members 12 and 13 along the levers. Ends of U-shaped levers 9 and 10, pivotally attached to both sides of frame segments 5 through 8 at pivot points 14, provide support forces to frame 101. Attachments 15 of levers 10 to each side of head support section 5 can be optionally fixed or pivotal. The position of the support point along the spine of each lever 9 and 10 establishes the ratios of the support forces at the respective ends of the lever. If these ratios approximately match in the inverse the ratios of the weights of the body segments supported thereby, then a balanced floating action is achieved as the forces preserve their relative magnitudes regardless of small up or down motions of the supported body and the distribution of support forces matches the distribution of weight in the body, thus tending to relieve muscle tension. Membrane 2 in FIG. 1 is a mesh of wire segments which are interconnected to provide pivotal freedom at the crosspoints so as to impart a high degree of conformability in a direction normal to the plane of the membrane. Such a wire mesh is referred to in the bedding industry as "link fabric". For advantageous application to the present invention tension in membrane 2 need only be applied in a transverse direction relative to the longitudinal axis of the bed by springs 4, for example.

Rigid cross braces 16 act as compression members for frame segments 14. Braces 16 are droop shaped to allow clearance for membrane 2 when it is deflected under the weight of the supported body. For the bed embodiment four segments, as shown in FIG. 1, represent the minimum number for providing, in combination with membrane 2, a resilient support for foam mattress 3. Such support conforms to the contours of the human body in various orientations about a longitudinal axis while providing a relatively smooth pressure distribution on the body surface. The local resultant support forces match well with the distribution of weight among the body segments.

A greater number of frame segments could be used without departing from the principle of this invention. For a number of frame segments larger than four a more complex system of levers than that shown in FIG. 1 would be required. In such a case a lever-on-lever or "whiffle-tree" arrangement could be used. Frame 101 and platform 11 can be encased for aesthetic reasons in upholstery to give the appearance of conventional box springs.

Additional refinements, not shown in FIG. 1, may be desirable, such as, for example, for the purpose of limiting the vertical excursions of the bed surface. Means for damping the action, especially when the user gets on or off the bed, can also be provided. Moreover, it may be desirable for aesthetic reasons to have the surface of the bed assume a nearly flat configuration when not in use. Suitable means for accomplishing these objects will occur to those skilled in the art. The disclosure of the details of such refinements is therefore deemed not to be necessary.

FIG. 2 depicts the structure of FIG. 1 with topping mattress 3 occupied by a human figure in the supine, i.e., on the back, position. Structural parts are numbered as in FIG. 1. FIG. 2 clearly shows how, through the cooperation and interaction of balance levers 9 and 10 and frame segments 5 through 8, the reclining body is supported in a natural posture with each body section supported in accordance with its weight. It is apparent that positive support is provided to head, shoulder, lumbar and pelvic regions, as well as to upper and lower legs.

FIG. 3 similarly shows graphically how the structure of FIG. 1 adapts to the human figure lying in the prone, i.e., face down, position on mattress 3. Because the contours of the human figure are relatively flatter in the front than in the back, mattress 3 assumes an almost planar horizontal aspect for the prone resting position in contrast to the hill and dale configuration of FIG. 2.

Figure 4:
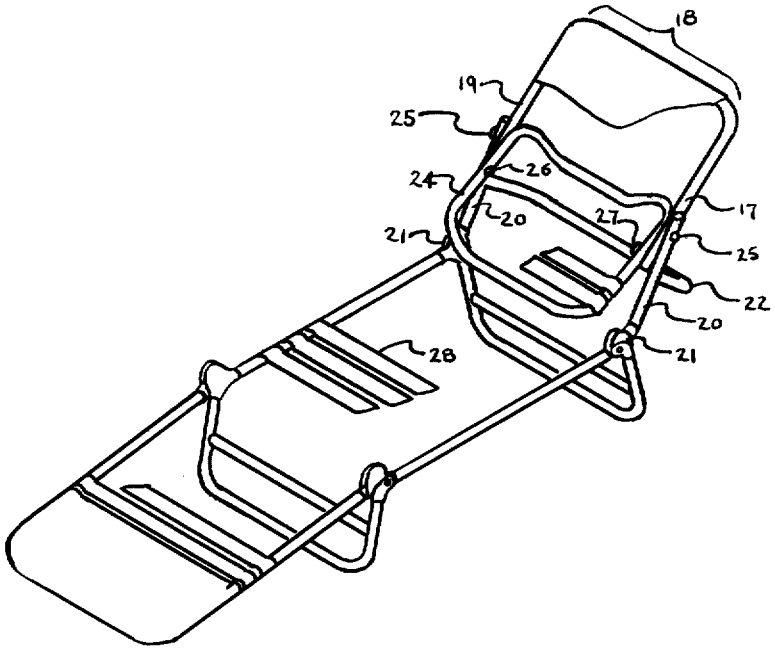
FIG. 4 is a perspective view of a folding beach chair incorporating the support system of my invention for the upper torso only.
Figure 5:
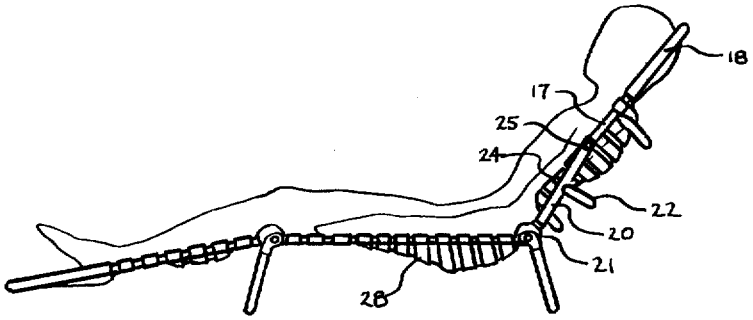
FIG. 5 is a side pictorial view showing the folding beach chair of FIG. 4 accommodating a user sitting in a nearly upright position.
Figure 6:
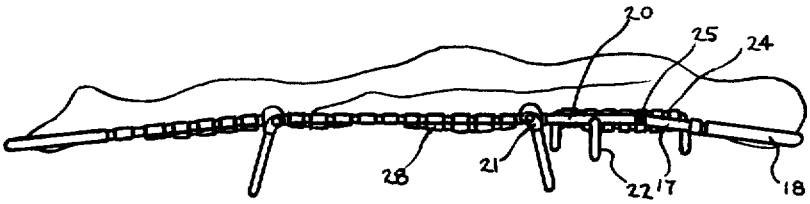
FIG. 6 is a side pictorial view showing the folding beach chair of FIG. 4 accommodating a user lying with the chair in an outstretched configuration.

FIGS. 4, 5 and 6 show a second embodiment of the present invention in which a folding beach chair is modified with an independent segmented floating back whose segments correspond to the head and torso segments of the bed shown in FIG. 1. In FIG. 4 extensions 17 and 19 of U-shaped head segment 18 are analogous in function to lever 10 in the bed embodiment of FIG. 1. Bars 17 and 19 are supported at pivots 25 close to the ends of struts 20 which are adjustably positioned by means of latching hinged joints 21. Struts 20 are analogous to fixed support members 13 in the embodiment of FIG. 1 and provide a relatively rigid base for head and torso segments 18 and 24. A sleeve or other restraint can advantageously be placed over the stub end of strut 20 and bar 17 at pivot 25 to prevent head segment 18 from rotating too far in the backward direction. Alternatively, such restraint can be obtained by having bar 17 be a hollow member loosely surrounding the stub end of strut 20. Cross brace 22 ties and rigidizes struts into a firm sub-unit. Torso support segment 24 is pivotally attached near the ends of bars 17 and 19 at points 26 and 27, a predetermined distance from pivot points 25 joining head segment 18 to struts 20. The closed loop torso segment 24 is thus supported in a manner analogous to that of torso support segment 6 in FIG. 1. Because extensions 17 and 19 are part of head segment 18 they correspond in function to levers 10 of FIG. 1 when fixedly attached at point 15. All segments of the beach chair of FIG. 4, including head and torso segments 18 and 24, are covered with suitable cross webbing strips 28.

FIG. 5 depicts the structure of FIG. 4 when occupied by a human figure in a semi-reclining position. Structural parts are numbered as in FIG. 4. FIG. 5 shows how torso section 24 positively supports both lumbar and shoulder sections of the human back in a natural position, while at the same time head segment 18 cradles the head comfortably.

FIG. 6 similarly depicts the structure of FIG. 4 when occupied by a human figure in a fully reclining prone position. Now torso segment 24 fully supports the human chest and head segment 18 cradles the head.

Various other modifications of my invention will occur to those skilled in the bed and chair arts without departing from the spirit and scope of the following claims.

What I claim as my invention is:

1. An article of furniture for supporting the human body in sitting and reclining positions with a preselected support force distribution which adapts itself to body contours comprising, in combination:

a rigid base;

a frame for supporting a mattress or the like divided longitudinally into a plurality of segments, at least one of which is independent of other segments;

cross bracing members for intermediate segments of said frame;

a membrane resiliently stretched transversely of each of said segments; and at least one balance lever intermediately pivoted to said base and endwise attached to adjacent segments of said frame on each long side thereof to support said segments.

2. The article of furniture defined in claim 1 in which the end segments of said frame are substantially U-shaped, said membrane is continuous and is resiliently connected to all segments of said frame, and the intermediate pivots on said balance levers are distant from the ends thereof in inverse ratio to the weights to be supported at said ends.

3. The article of furniture defined in claim 1 in which said frame is divided into four independent floating segments:

a U-shaped first segment for supporting the head of a human body, a second segment crossbraced for supporting the upper torso of a human body, a third segment crossbraced for supporting the pelvic and upper leg sections of the human body, and a U-shaped fourth segment crossbraced for supporting the lower leg section and feet of the human body.

4. The article of furniture defined in claim 3 in which each of said first through fourth frame segments are pivotally attached to ends of a pair of balance levers on the long sides of said segmented frame.

5. The article of furniture defined in claim 3 in which said first and second frame segments are pivotally attached to opposite ends of a first pair of said balance levers and said third and fourth frame segments are pivotally attached to opposite ends of a second pair of balance levers.

6. The article of furniture defined in claim 3 in which said first frame segment is fixedly attached to ends of a pair of said balance levers; and said second, third and fourth frame segments are pivotally attached to ends of pairs of balance levers.

7. The article of furniture defined in claim 3 in which said first frame segment is rigidly attached to one end of each of a pair of said balance levers, said second frame segment is pivotally attached to the opposite ends of each of said first pair of said balance levers, and said third and fourth frame segments are pivotally attached to opposite ends of a second pair of balance levers.

8. The article of furniture defined in claim 1 including non-pivoted lower torso and leg sections in which said frame comprises only two pivoted segments:

a first U-shaped head segment pivoted from base struts at intermediate points along the open ends thereof, and a second upper torso segment pivoted at the extremities of the open ends of said first segment;

said second segment being crossbraced at upper and lower extremities thereof, and one or more contiguous membranes being stretched across said first and second segments.

9. The article of furniture defined in claim 3 in which a first frame segment is pivotally attached at intermediate points to said base and at end points to said second segment, and said third and fourth segments are directly attached to said base.

* * * * *